US005402841A

United States Patent [19]

Tierney

[11] Patent Number: 5,402,841

[45] Date of Patent: Apr. 4, 1995

[54] DOOR ASSEMBLY FOR A TEMPERATURE CONTROLLED STORAGE STRUCTURE

[76] Inventor: Patrick F. Tierney, 810 NW. Bellevista, Gresham, Oreg. 97030

[21] Appl. No.: 72,393

[22] Filed: Jun. 7, 1993

[51] Int. Cl.[6] ..... E05D 15/06

[52] U.S. Cl. ..... 160/195; 160/209

[58] Field of Search ..... 160/209, 195, 194, 210, 160/201; 16/95 R, 96 R, DIG. 1

[56] References Cited

U.S. PATENT DOCUMENTS

| | | | |
|---|---|---|---|
| 2,045,060 | 6/1936 | Wheatley | 160/195 |
| 2,069,665 | 2/1937 | Bouthillier | 160/195 |
| 3,507,322 | 4/1970 | Tetrick et al. | 165/61 |
| 4,350,199 | 9/1982 | Pino | 160/195 |
| 4,509,383 | 2/1986 | Wentzel | 160/229.1 |
| 4,901,538 | 2/1990 | Anthony | 62/237 |

*Primary Examiner*—Blair M. Johnson
*Attorney, Agent, or Firm*—James D. Givnan, Jr.

[57] ABSTRACT

An overhead door assembly is disclosed having a pair of rails each with upright and horizontal segments. Pivot supports at the lower ends of the upright segments permit the rails and a door thereon to move into and out of the doorway of a temperature controlled storage structure. A control shaft imparts movement to the rails by arm assemblies each including pivotally coupled arms to tilt the rail segments and door thereon between open and closed positions. The door is held in a closed position by an over-center relationship in each arm assembly. The control shaft is manually actuated while modified rail positioning arrangement includes a pneumatic cylinder and a valve control for rail positioning. Seals about the door and between panels of the door render the storage structure airtight.

11 Claims, 2 Drawing Sheets

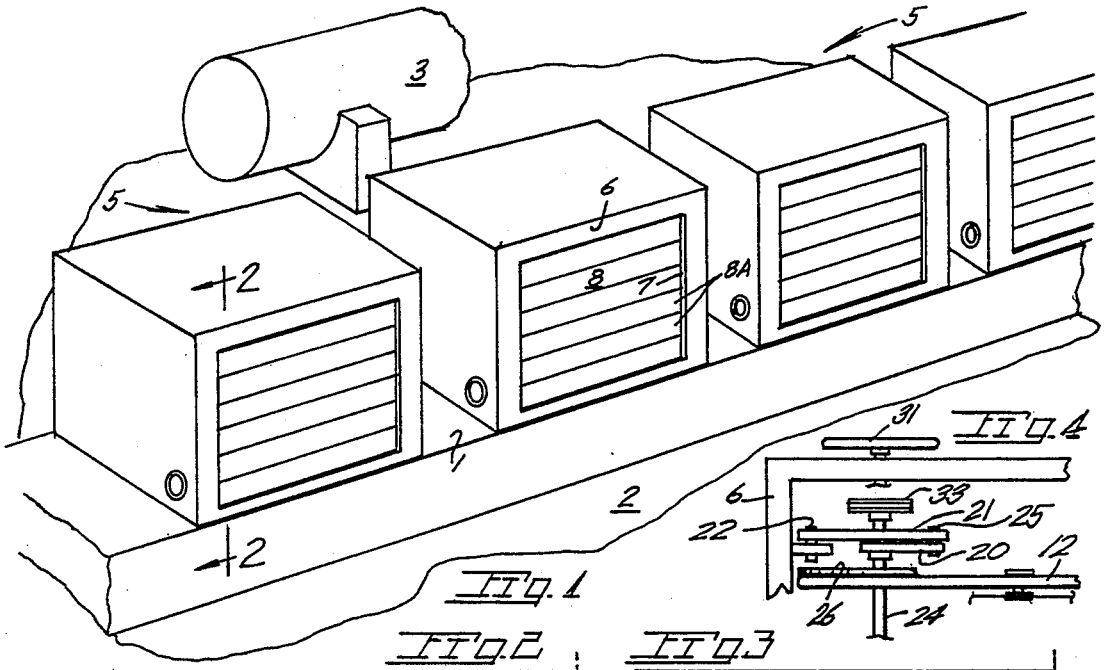
FIG. 1
FIG. 4
FIG. 2
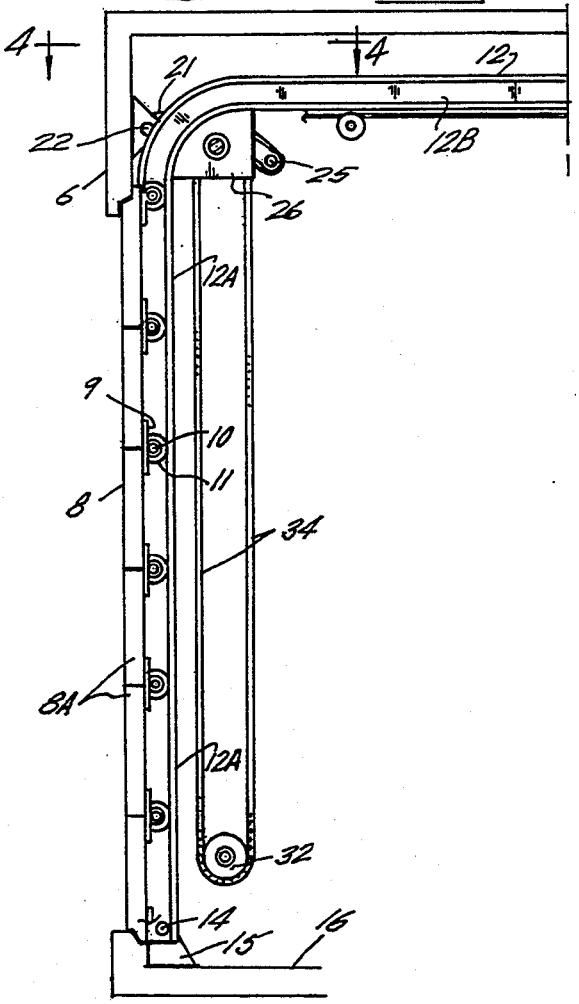
FIG. 3
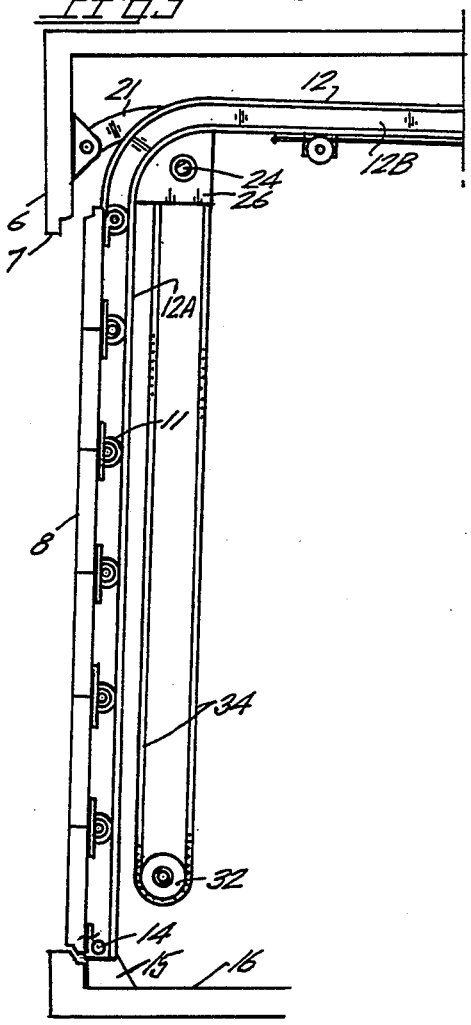

DOOR ASSEMBLY FOR A TEMPERATURE CONTROLLED STORAGE STRUCTURE

BACKGROUND OF THE INVENTION

The present invention concerns overhead door assemblies and their use in temperature controlled storage structures for temporary storage of perishable items such as various types of foods.

The shipping of highly perishable items of food by air is complicated by the fact that the food must be stored at reduced temperatures when stored between flights. Existing storage facilities at airports do not permit convenient storage and retrieval of small food shipments nor expeditious handling of same by ground personnel. Accordingly, time is often lost in handling such shipments to the extent the perishable article spoils. To expedite the handling of food articles it has been found desirable to store same in storage structures arranged in rows or in place in rows on mobile bases with each having an overhead door to facilitate rapid transfer of articles into and out of the structures.

U.S. Pat. No. 4,901,538 shows a system for refrigerating perishables while in place in the air cargo container. A wheel supported refrigerator unit discharges cold air through conduits into the containers. Problems encountered in storing perishable articles at airports are discussed in this patent.

U.S. Pat. No. 3,507,322 discloses a system for the shipping and storage of perishable food articles in cabinets each with a pair of conduits for coupling to a piping circuit carrying a heating or cooling medium with quick disconnects provided for conduit attachment.

In a typical overhead door installation a certain amount of clearance is necessary to permit unobstructed, vertical door opening and closing movement along upright rails adjacent the doorway opening. In structures not requiring a controlled temperature e.g., a garage, a certain amount of such clearance is acceptable. An overhead type sealable door for walk in temperature controlled storage structure is not found in the prior art to the extent known.

SUMMARY OF THE PRESENT INVENTION

The present invention is directed toward a storage structure for perishables and having an overhead door assembly for incorporation into the temperature controlled storage structure having a relatively large door opening sealed to maintain desired storage conditions.

In the storage of food products shipped via air cargo a problem exists in providing suitable ground storage structures which often are remote from the parked aircraft to prevent receiving and discharging the stored perishables in rapid fashion. A part of the problem exists in providing nearby storage structures highly accessible to loading personnel for frequent loading and discharge of articles. The present storage structure has an overhead door assembly with positionable rails on which is entrained the overhead type door which, in its lowermost position, is displaceable into and out of sealed engagement with the perimeter of the structure door opening. The rails of the present door assembly swing, about an axis into sealed engagement with the perimeter of the door opening. For moving the door rails to seal the door an arm assembly provides for an over-center lock to maintain the door in a sealed and locked position. Control means activated by an operator permits actuation of the arm assembly to displace the door to seal and unseal same. An alternative rail positioning means includes air cylinders coupled to each of the rails with a suitable valve control provided adjacent the exterior of the storage structure for operator actuation. Accordingly provision is made for the travel of an overhead door when in its lowered position into and out of the doorway of a storage structure to facilitate the formation of a seal about the door perimeter.

Important objectives of the present invention include the provision of a mobile or fixed storage structure with positionable rails serving to locate a door entrained thereon into and out of sealed engagement with a doorway to preserve a controlled temperature and/or humidity in the storage structure; the provision of an overhead door assembly in a storage structure wherein rail positioning means include an arm assembly having an over-center locking capability to maintain the door in structure sealing abutment with the perimeter of the door opening; the provision of an overhead door assembly including rails positionable along with a door thereon about a horizontal axis toward and away from the doorway of a storage structure for perishable food articles; the provision of an overhead door assembly which utilizes a segmented overhead door which, when in a vertical position, may be displaced into and out of a storage structure doorway to effect a seal therewith.

BRIEF DESCRIPTION OF THE DRAWINGS

In the drawings:

FIG. 1 is a perspective view of a series of storage structures for the storage of perishable food items such as those in storage between air cargo flights;

FIGS. 2 and 3 are vertical sectional views of a door for the storage structure located respectively in a closed and in a retracted position;

FIG. 4 is a horizontal sectional view taken downwardly along line 4—4 of FIG. 2;

DESCRIPTION OF THE PREFERRED EMBODIMENT

Figures 5, 6, 7, 8, 9, 10:
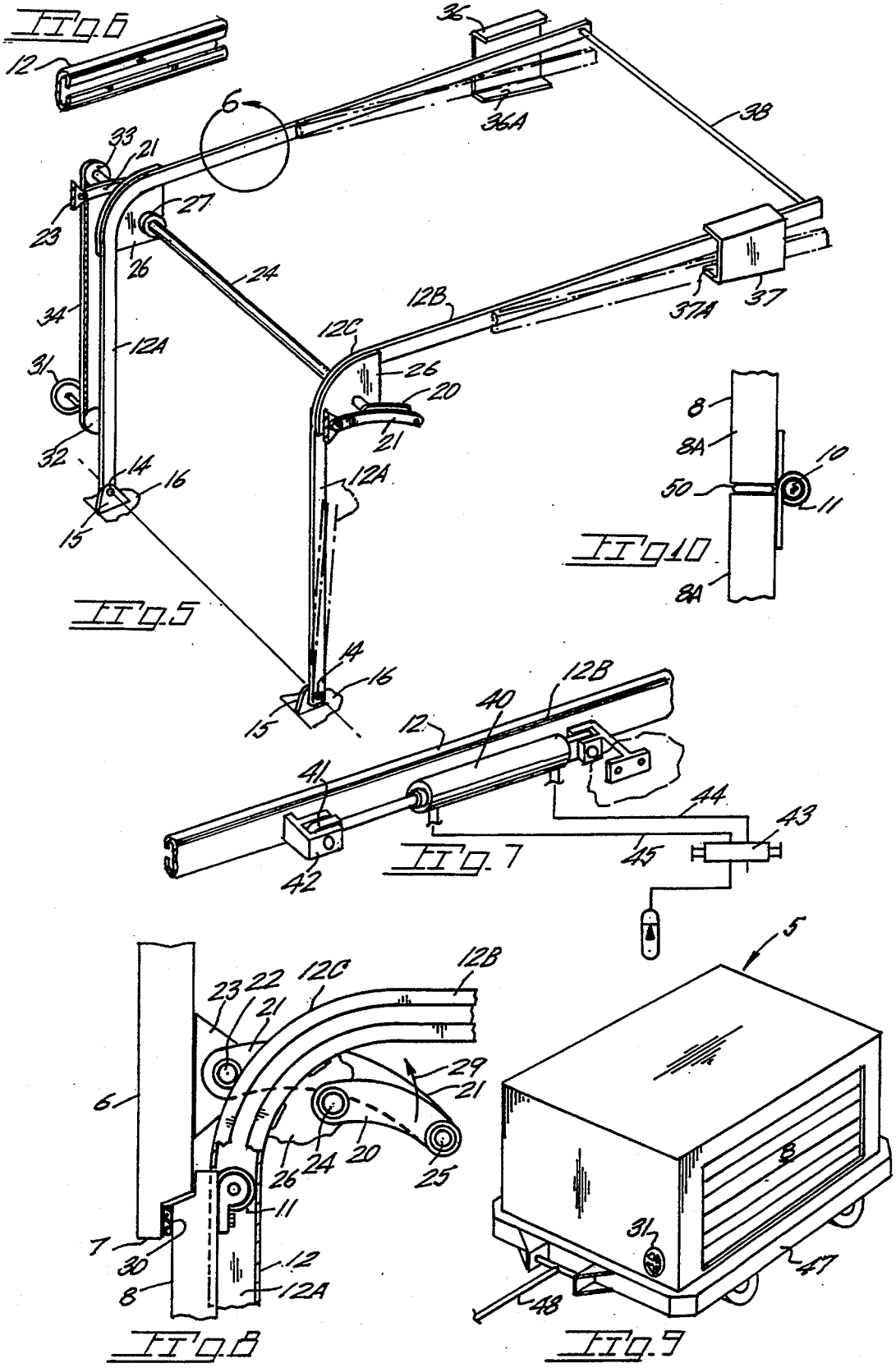
FIG. 5 is a perspective view of the rails of the overhead door system with the door removed for clarity of illustration.
FIG. 6 is an enlarged fragmentary view of the segment of the rail.
FIG. 7 is a perspective view of a rail fragment equipped with a rail positioning pneumatic cylinder.
FIG. 8 is a fragmentary elevational view of a rail segment and rail control arms.
FIG. 9 is a perspective view of a storage structure on a mobile base.
FIG. 10 is a fragmentary side elevational view of door panels with seal therebetween.

With continuing attention to the drawings wherein reference numerals indicate parts similarly hereinafter identified, the reference numeral 1 indicates a loading platform disposed along a course 2 for cargo laden vehicles such as those used for unloading and transferring cargo from and to aircraft. A storage tank at 3 provides a source for providing each of the following described storage structures with $CO^2$ to maintain the structures within the desired temperature range for the perishable articles stored therein.

Indicated generally at 5 are a series of storage structures each in communication with tank 3 by suitable conduits, valving and temperature controlling means.

The storage structures are insulated and of walled configuration with a frontal wall 6 defining a door opening 7. The following description to one storage structure 8 is equally applicable all of same. An overhead door 8 is of the segmented type having panel segments at 8A. The segments are joined by hinges 9 with a hinge pin 10 which conveniently each receives a roller 11.

Rails at 12 are of C-shape in section to each receive a set of rollers carried at the sides of overhead door 8. The rails 12 include upright segments 12A and generally horizontal segments 12B to permit travel of the door from a closed, vertical position to a temporary open position intermediate rail segments 12B. Opening and closing movement of door 8 is assisted by a cable and spring arrangement common to overhead type doors. The lowermost ends of rail segments 12A are each pivotally mounted at 14 on pivot pins in place in brackets 15 mounted on the floor 16 of the storage structure. Accordingly the rails 12 move about the horizontal axis of pivot pins 14.

Rail positioning means includes arm assemblies typically shown in FIG. 8, with each offset from a curved segment 12C of rail 12 and including a control arm 20 and a wall mounted support arm 21 with the arms pivotally coupled at their outer ends at 25. A wall mounted bracket 23 carries arm 21 on pin 22. The control arms 20 of each arm assembly are carried jointly by an arm control shaft 24. Affixed to curved segment 12C of each rail 12 is a plate 26 in which control shaft 24 is journaled by a bearing 27 (FIG. 5). From the foregoing it will be seen that counter clockwise rotation of shaft 24, per arrow 29 in FIG. 8 by later described rail control means, will cause both plates 26 and the rail attached thereto to retract the rails away from the door opening 7 to the position viewed in FIG. 3. Oppositely, when closing of the door the arms 20 and 21 and their pivot points permit the axis of control rod 24 to be displaced into the over-center locked position with door 8 seated and locked within doorway opening 7 of the storage structure. The sectional view of FIG. 8 with the door shown seated in abutment with from wall 6 of the structure may be considered typical of the engagement of the remaining upright and horizontal door edges. A resilient seal at 30 extends about the doorway opening 7 and preferably is of the heated type with wire elements therein to prevent door 8 from becoming frozen to the perimeter of the door opening.

Control means for imparting rotational movement to shaft 24 to displace same during door locking and unlocking, is accomplished by a wheel 31 adjacent the exterior of the structure carried by a shaft journaled in a side wall of the structure and provided with a sprocket 32 and a chain 34 with a companion sprocket at 33 suitably affixed to control shaft 24. Rotation of the control wheel by a worker imparts arcuate movement to shaft 24 to relocate the arms into and out of their over-center locked relationship of FIG. 8 with shaft 24 displaced, along with plate 26 and the rail segments associated therewith.

A pair of limit stops at 36 and 37 are engaged by the rearward end portions of horizontal rail segments 12B. A tie bar 38 joins said segments and rigidity to the rails. Flanges 36A and 37A are contacted by rails 12 when in their lowermost position. Limit stops 36–37 are in place on a wall of the storage structure.

With attention to FIG. 7, the alternative rail positioning means shown includes a pneumatic cylinder 40 which has a rod end 41 received in a clevis 42 carried by a horizontal rail segment 12B. A suitable valve control 43 regulates a pressurized medium through conduits 44 and 45 to extend and retract the cylinder piston rod to position the rails and particularly upright segment 12A thereof and door thereon toward and away from door opening 7 for closing and opening same. The first described rail positioning means is not utilized with the latter described rail positioning means.

As earlier noted, the storage structure generally at 5 may be supported in place on mobile bases depending on the space available at an airport for the storage units. Where space is critical, or not available for the present storage structures, the same may be rendered mobile by placement on a cart or trailer 47 of the type currently in use at airports. A tow bar 48 may be coupled to a tractor vehicle or another storage structure constituting part of several storage structures moved by the tractor vehicle.

Should it be desirable to maintain the storage structure 5 at above atmospheric pressure, door 8 may be additionally provided with resilient seals 50 per FIG. 10 with seal carried by an edge of one segment of a pair of adjacent panel shaped segments 8A so as to be at least partially compressed when the door 8 is closed. Accordingly, the door 8 as well as the door perimeter are sealed.

While I have shown but one embodiment of the invention, it may be embodied still otherwise without departing from the spirit and scope of the invention.

Having thus described the invention, what is desired to be secured by a Letters Patent is:

I claim:

1. An overhead door assembly for a temperature controlled storage structure for perishables having a door opening and comprising, rails including upright and horizontal segments, a door comprised of panels entrained on said segments for abutment with the structure adjacent said door opening to close same, resilient means located between the door perimeter and that part of the structure defining said doorway, pivot means supporting said rails in said storage structure permitting displacement of said rails and their upright and horizontal segments and said door about a horizontal axis away from said door opening, rail positioning means coupled to said rails; and control means for actuating said rail positioning means.

2. The assembly claimed in claim 1 wherein said pivot means include pivot pins, each of said pivot pins supporting one of said rails for travel about said horizontal axis, said pivot pins each in pivoted engagement with the upright segments of each of said rails.

3. The assembly claimed in claim 2 wherein said control means includes a door control arm, said rail positioning means including a support arm having a proximal end pivotally attached to said structure and a distal end pivotally attached to the other end of said control arm, said control means additionally including an arm control shaft for positioning said control arm and said support arm into and out of an over-center relationship to lock the door in place in said door opening.

4. The assembly claimed in claim 1 wherein said door comprises segments hingedly joined to each other, seals interposed between said segments to seal the door against the passage of a coolant between said segments.

5. The assembly claimed in claim 1 wherein said rail positioning means includes a pneumatic cylinder.

6. The assembly claimed in claim 1 additionally including limit stop means supporting the rails at one extreme of travel.

7. A door assembly for a temperature controlled storage structure having a doorway, said assembly comprising, a door comprising panel segments and equipped with rollers, rails having upright segments adjacent said door and on which said rollers are entrained, pivot means supporting said rails for positioning same about a horizontal axis for travel toward and away from said doorway during opening and closing of said door, rail positioning means coupled to said rails for positioning the upright rail segments and said door when in place thereon toward and away from said doorway, said door when in place on said upright rail segments positionable about said axis into engagement with that portion of the storage structure defining said doorway, resilient means effecting a seal between said door and said storage structure, and control means for actuating said rail positioning means.

8. The assembly claimed in claim 7 wherein said control means includes a control shaft and a control arm on said shaft, said rail positioning means including a support arm having one end swingably attached to said structure and a distal end pivotally coupled to said control arm, said control arm and said support arm positionable by said control shaft into and out of an over-center locking relationship to lock the door in place in said doorway.

9. The assembly claimed in claim 7 wherein said rail positioning means includes a pneumatic cylinder coupled to said rails.

10. An overhead door assembly for a temperature controlled storage structure for perishables having a door opening and comprising, rails including upright and horizontal segments, a door entrained on said segments for abutment with the structure adjacent said door opening to close same, said door comprised of panel shaped segments, hinge means joining said panel shaped segments in edge-to-edge fashion, seals disposed along each of said segments for engagement with an adjacent panel shaped door segment to effect an airtight segmented door, pivot means supporting said rails in said storage structure permitting displacement of said rails and said door about a horizontal axis away from said door opening, rail positioning means coupled to said rails; and control means for actuating said rail positioning means.

11. The overhead door assembly claimed in claim 10 additionally including seal means between the door perimeter and that portion of the structure defining said doorway.

* * * * *